US008226178B2

(12) United States Patent
Kümmel

(10) Patent No.: US 8,226,178 B2
(45) Date of Patent: Jul. 24, 2012

(54) BUILT-IN REFRIGERATOR WITH DISPENSING DEVICE

(75) Inventor: Roland Kümmel, Nellingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 520 days.

(21) Appl. No.: 12/310,338

(22) PCT Filed: Aug. 7, 2007

(86) PCT No.: PCT/EP2007/058183

§ 371 (c)(1),
(2), (4) Date: Feb. 20, 2009

(87) PCT Pub. No.: WO2008/025658

PCT Pub. Date: Mar. 6, 2008

(65) Prior Publication Data

US 2009/0314025 A1 Dec. 24, 2009

(30) Foreign Application Priority Data

Aug. 29, 2006 (DE) ..... 10 2006 040 358

(51) Int. Cl.
*A47B 97/00* (2006.01)

(52) U.S. Cl. ..... 312/204; 312/405

(58) Field of Classification Search ..... 312/204, 312/405, 405.1; 62/449, 389; 52/204.54, 52/212

See application file for complete search history.

(56) References Cited

U.S. PATENT DOCUMENTS

| | | | | |
|---|---|---|---|---|
| 4,209,999 | A * | 7/1980 | Falk et al. | 62/344 |
| 5,442,933 | A * | 8/1995 | Unger | 62/275 |
| 5,570,548 | A * | 11/1996 | Hopper | 52/204.5 |
| 5,806,942 | A * | 9/1998 | Jenkins et al. | 312/204 |
| 6,055,823 | A * | 5/2000 | Baker et al. | 312/404 |
| 6,272,801 | B1 * | 8/2001 | Suh | 52/211 |
| 6,574,935 | B2 * | 6/2003 | Wang Chen | 52/455 |
| 6,925,767 | B2 * | 8/2005 | Krochmal et al. | 52/212 |
| 2004/0193414 | A1 * | 9/2004 | Calistri-Yeh et al. | 704/245 |
| 2004/0255529 | A1 * | 12/2004 | Pielmeier | 52/212 |
| 2005/0268638 | A1 * | 12/2005 | Voglewede et al. | 62/389 |
| 2009/0071184 | A1 * | 3/2009 | Buchstab et al. | 62/389 |
| 2009/0282856 | A1 * | 11/2009 | Buchstab et al. | 62/389 |

FOREIGN PATENT DOCUMENTS

| | | | |
|---|---|---|---|
| DE | 102006018204 | A1 | 10/2007 |
| GB | 2246195 | A | 1/1992 |

* cited by examiner

*Primary Examiner* — Hanh V Tran

(74) *Attorney, Agent, or Firm* — James E. Howard; Andre Pallapies

(57) ABSTRACT

A built-in refrigerator having a housing formed with a front dispenser opening therein, the refrigerator including a frame member for surrounding an opening in a decor plate covering at least a portion of a front side of the housing and disposed in front of the dispenser opening, wherein the frame member is formed as a cover piece overlapping the edges of the opening, and an inner sleeve arranged between the cover piece and the front side of the housing.

17 Claims, 3 Drawing Sheets

BUILT-IN REFRIGERATOR WITH DISPENSING DEVICE

BACKGROUND OF THE INVENTION

The present invention relates to a built-in refrigerator with a dispensing device, such as an ice and/or water dispenser, which is accessible through a front dispenser opening of the appliance.

If a refrigerator with such a dispenser opening is intended to be used as a built-in appliance, an opening matching the dispenser opening must be provided in a decor plate acting as a facing for the appliance at its installation location. However, it is difficult to introduce at a later stage an opening in a finished decor plate, whereby the design and/or machining quality of the edges of the opening match those of the outer edges of the plate. A further problem is that the position in which the decor plate is attached to the refrigerator is determined not only by the refrigerator itself, but by the mounting environment. More precisely, the outer edges of the decor plate forming the facing of the refrigerator have to be aligned with the edges of the fronts of adjacent units, and the width of the gap between the decor plate and the fronts of adjacent units should be uniform on all sides. In order to meet these requirements it is generally necessary to provide an adjustable suspension mounting for the decor plate on the refrigerator. If, however, the position of the decor plate has to be adjusted with respect to the fronts of adjacent units, it is generally not possible to precisely align the opening in the decor plate with the dispenser opening.

In order to remedy this problem it is known to fit into the opening of the decor plate, with a certain amount of clearance in relation to said opening, a frame piece that overlaps the edges of the opening formed in the decor plate and which frame piece includes a sleeve that is introduced into the opening of the decor plate and anchored to the built-in refrigerator. The length of such a sleeve must be adapted to the thickness of the decor plate. In the majority of cases the decor plate has a thickness of 19 mm; but double-thickness decor plates are also used. There is therefore a need for a frame piece that can be used with decor plates of varying thickness. A known frame piece that meets this requirement has a sleeve of a length suitable for a unit having a thick front, which sleeve is provided with a predetermined breaking point in order to shorten it and then allow it to be used with a unit having a thinner front. However, this solution has the drawback that the frame piece can be used unmodified only in the less common case where a thick decor plate is used, whereas in the vast majority of cases in which a thinner decor plate is used, the frame piece has only to be made to fit. Furthermore, the manufacture of the known frame piece requires a great deal of material, a part of which in most cases is immediately thrown away during fitting. In addition, there is a risk that the frame piece is damaged during shortening and has to be discarded, so that if no replacement is available, the fitting of the appliance can only be completed after the procurement of a replacement, which results in considerable costs and is irksome for the user.

BRIEF SUMMARY OF THE INVENTION

The object of the invention is therefore to create a built-in refrigerator with a front dispenser opening and a frame piece in which in the majority of cases the frame piece can be used without adjustment. A further object is to avoid unnecessary use of material in the manufacture of the frame piece. A further object is to avoid the risk of damage to the frame piece during fitting to a decor plate of a given thickness.

According to the invention, all these objects are achieved by a built-in refrigerator with a housing having a front dispenser opening and a frame piece for surrounding an opening in a decor plate cladding the front side of the appliance, lying in front of the dispenser opening, in which built-in refrigerator the frame piece is made up of a cover piece overlapping the edges of the opening, and an inner sleeve arranged between the cover piece and the front side.

Inner sleeves can be provided in varying lengths, it then being possible for the cover piece with a short inner sleeve to be joined to a frame piece matched to a thin decor plate, and with a long inner sleeve to be made to match a thick decor plate.

Alternately, the cover piece can already include an outer sleeve which engages with the opening in the decor plate. While the length of the outer sleeve is adapted to a thinner decor plate, the inner sleeve can be simply removed during the fitting of such a decor plate. While the length of the inner sleeve adjusts for the difference in thickness of the decor plates, in the assembled condition the frame piece can be employed with a thicker decor plate.

At the manufacturer's discretion, the inner sleeve can be supplied with every refrigerator to allow decor plates of varying thickness to be fitted at any time; to save material during manufacture provision can also be made for the inner sleeve to be supplied only as an optional accessory at the customer's request.

According to a simple embodiment, the two sleeves can fit one inside the other in a telescopic fashion. In a preferred embodiment the inner surfaces of the two sleeves are joined so as to be flush with each other, so that the fact that the frame piece is made up of two individual parts is hardly noticeable to an observer. This is made possible, in particular, with the aid of a tongue-and-groove joint between the two sleeves.

In order to hold the inner sleeve and cover piece together they are preferably provided with interactive latching means.

In particular, these latching means can include a first latching contour at one edge of the cover piece, preferably from its outer sleeve, and a second latching contour engaging at the first latching contour, at one arm projecting from the inner sleeve. An opposing arrangement with arms projecting from the cover piece is then preferably considered if the cover piece does not include any outer sleeve or, at best, a short outer sleeve, so that with a thinner decor plate the arms would have had to be removed to enable the outer sleeve to be fitted.

So that the arms do not impair the play between the outer sleeve and the decor plate, the first latching contour is preferably arranged within a recess in the edge, which recess fully accommodates the arm.

BRIEF DESCRIPTION OF THE DRAWINGS

Further features and advantages of the invention are revealed in the following description of exemplary embodiments, with reference to the attached figures, where.

DETAILED DESCRIPTION OF THE PRESENT INVENTION

Figure 1:
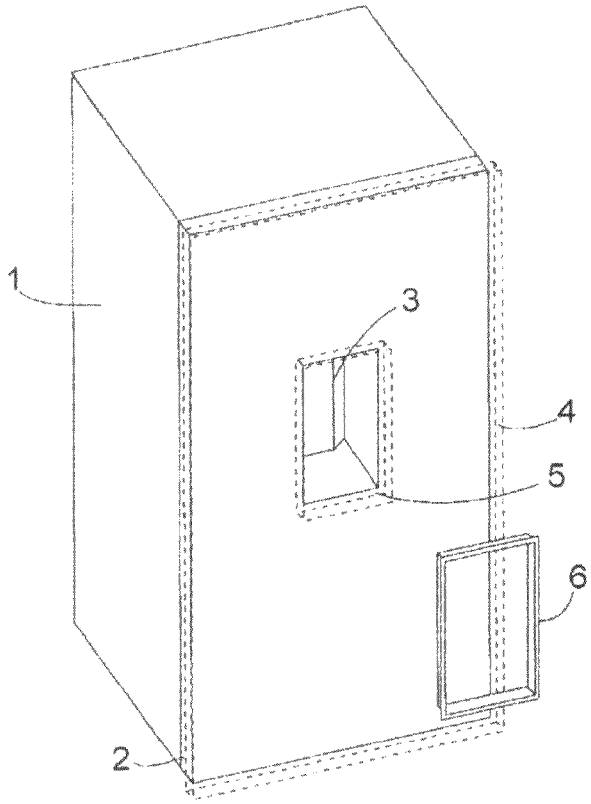
FIG. 1 shows a schematic, perspective view of a refrigerator according to the invention.

FIG. 1 shows a schematic, perspective view of a built-in refrigerator according to the invention. The appliance has a body 1 and a door 2 which enclose an inner space in which a dispensing device known per se—and therefore not shown here—for ice and/or chilled drinking water is housed. A dispenser opening for the water or ice is located in the top of a recess 3 sunk into the door 2. When the refrigerator is mounted at its place of use, a decor plate 4, shown transparent in the figure, is attached to the door 2 in an adjustable manner. An opening 5 cut into the decor plate 4 provides access to the recess 3. Dependent on the available freedom of movement for adjustment of the door 2, the height and width of the rectangular opening 5 have an oversize allowance with respect to the corresponding dimensions of the recess 3, so that in every possible position that the decor plate 4 can adopt on the door 2, the recess 3 remains completely clear.

A consequence of the adjustability of the decor plate 4 is that the edge zones of the door 2 surrounding the recess 3, which are clear in the opening 5, can have different widths to the right, left, above and below the recess 3. In order to conceal these edge zones, a frame piece 6 is provided, shown removed in FIG. 1, the construction of which is explained in detail in FIG. 2.

The frame piece 6 is made up of a cover piece 7 and an inner sleeve 8 arranged between the door 2 and the cover piece 7. The cover piece 7 and the inner sleeve 8 can be manufactured from injection molded plastic, for example. The cover piece 7 has walls 9, 9, 10, 10 abutting each other at right-angles, and in the mounted state engaging the opening 5 in the decor plate 4, and together forming an outer sleeve 28 and a web 11 running around the outer sides of these walls 9, 9, 10, 10. The width of the web 11 corresponds to at least the available freedom of movement for adjustment of the decor plate 4, so that in every possible position that the cover piece 7 can adopt at the opening 5, the edge of the opening 5 is fully covered by the web 11.

In the figure one part of the web 11 is shown cut away in order to show recesses 12, 13, each of which is formed at the outer sides of the vertical walls 9. A single prism-shaped latching projection 14 is formed in each of the recesses 12; each of the recesses 13 has a large number of latching projections which give the bottom surface of the recesses 13 a sawtooth-type profile. If desired, corresponding recesses may also be present on the horizontal walls 10.

Figure 3:
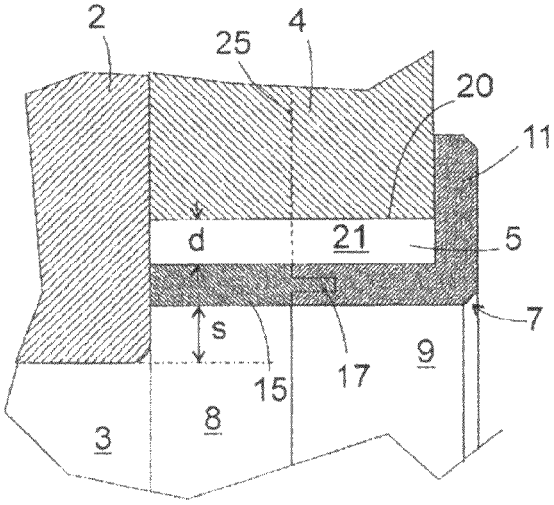
FIG. 3 shows a section through the frame piece and its surroundings in the fitted condition.
Figure 4:
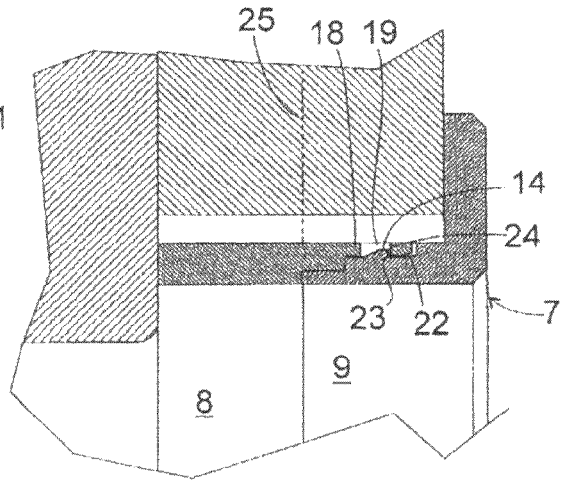
FIG. 4 shows a second section through the frame piece and its surroundings in an intersecting plane that is parallel to the intersecting plane of FIG. 4.
Figure 5:
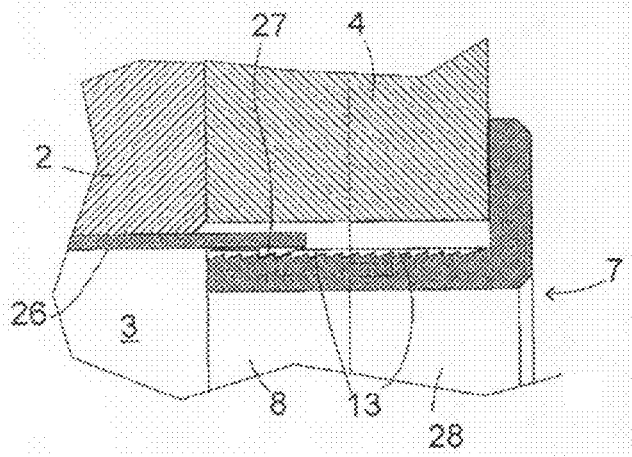
FIG. 5 shows a section through the frame piece and its surroundings according to a second embodiment.

In the assembled condition of the outer sleeve 28, the outer and inner faces of the vertical and horizontal walls 15 and 16, respectively, of the inner sleeve 8 extend flush with the outer and inner faces of the walls 9 and 10. The front faces of the walls 15, 16 facing the outer sleeve 28 have a continuous spring 17 which is intended to engage with a complementary groove in the outer sleeve 28, as can be seen in FIGS. 3 to 5. Flexible latching arms 18 are arranged in each case at positions that are complementary to the recesses 12 in the outer sleeve 28, so as to engage when the two sleeves 28, 8 are fitted together, it being possible for the latching projections 14 to snap into the openings 19 of the latching arms 18 and thus lock the sleeves 28, 8 together. Recesses 13 with sawtooth-type corrugated bases are also formed on the inner sleeve 8 in an extension of the corresponding recesses 13 of the outer sleeve 28.

Figure 2:
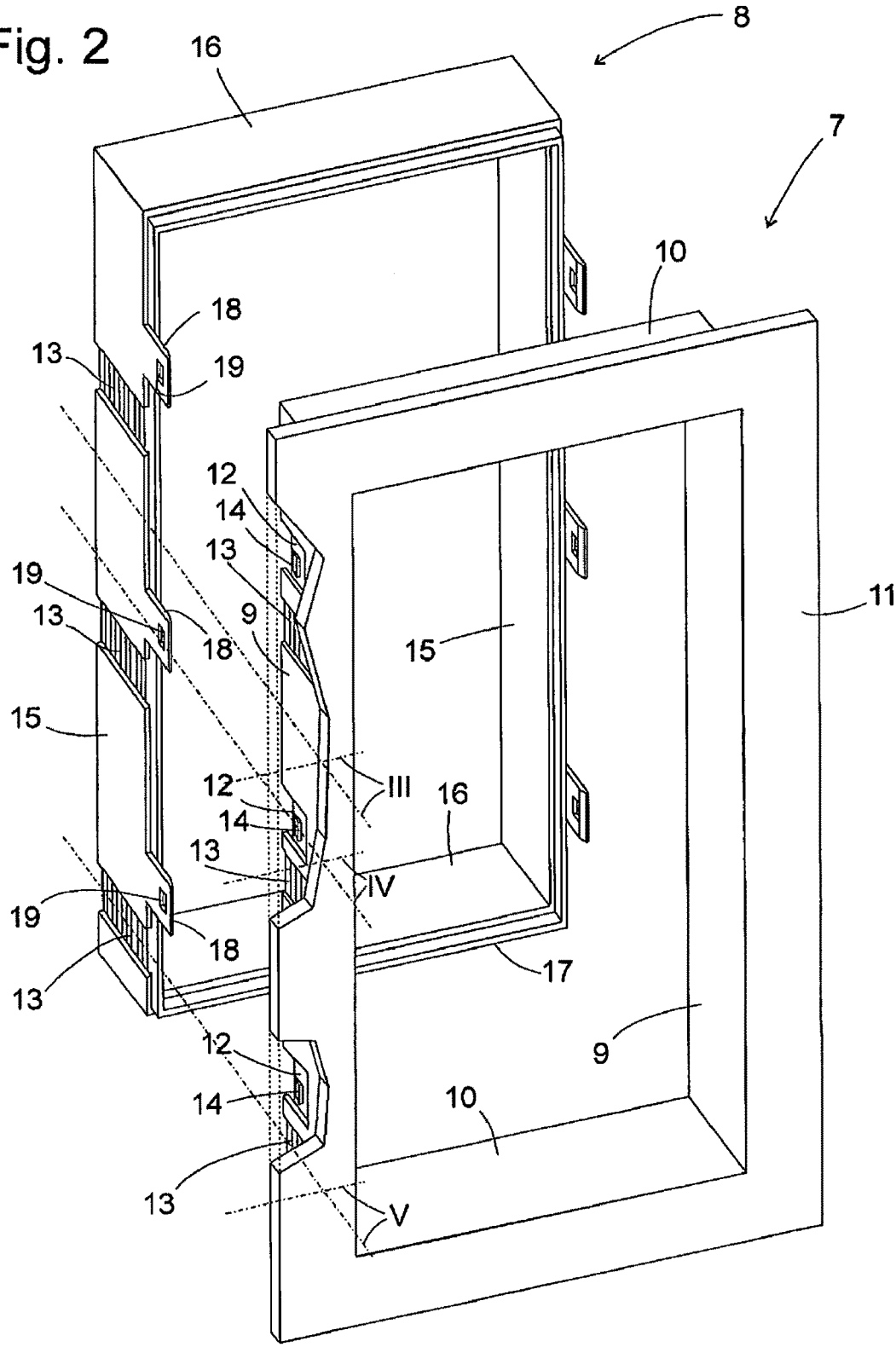
FIG. 2 shows an exploded, perspective view of the frame piece of the refrigerator of FIG. 1.

FIG. 3 shows a section through the cover piece 7 and the inner sleeve 8 in the assembled condition along a plane denoted by III in FIG. 2. The inner sleeve 8 is attached to the outside of the door 2, it being noted that a gap s between the inner face of each wall 15 and 16 of the sleeve 8 and one edge of the recess 3 that is adjacent and parallel to this wall is identical for all four walls 15, 16. A gap 21 that is covered by the continuous web 11 and whose width d can therefore be any value and can be different at all four walls of the sleeves 28, 8, is located between the walls of the sleeves 28, 8 and an adjacent edge 20 of the opening 5.

With the aid of a section along a plane denoted by IV in FIG. 2, FIG. 4 shows the interlocking arrangement of the two sleeves 28, 8. An oblique bevel 22 at the tip of the latching arm 18 facilitates bending of the latching arm 18 when sliding over the prism-shaped latching projection 14. In the locked state shown, bevels 23, 24 of the latching projection 14 and of the opening 5 lie transversely to the direction of intercoupling of the two sleeves 28, 8, so that the sleeves 28, 8 cannot be released from one another if pulled against the direction of intercoupling.

When a decor plate having half the material thickness is employed, as indicated in each case by a broken line in FIG. 3 and FIG. 4, the inner sleeve 8 could be omitted; instead, the walls 9 and 10 of the outer sleeve 28 would be directly attached to the door 2.

According to a second embodiment, in a section along the plane denoted by V in FIG. 2, FIG. 5 shows the cover piece 7 and the inner sleeve 8 in the state when mounted on the door 2. In this embodiment, in the recess 3, a further, in cross-section, rectangular sleeve 26 is partially engaged within the recess 3 and partially attached beyond the recess 3 in a projecting manner in the opening 5 of the decor plate 4. In the projecting area of the sleeve 26, latching projections 27 are formed at positions that are complementary to the recesses 13 in the sleeves 28, 8. If a thick decor plate 4 is used, as shown in FIG. 5, the latching projections 27 snap onto the sawtooth profile of the base of the recess 13 of the inner sleeve 8. If a thinner decor plate is used and the inner sleeve 8 is omitted, a corresponding locking action would be possible in the recesses 13 of the outer sleeve 28.

Figure 6:
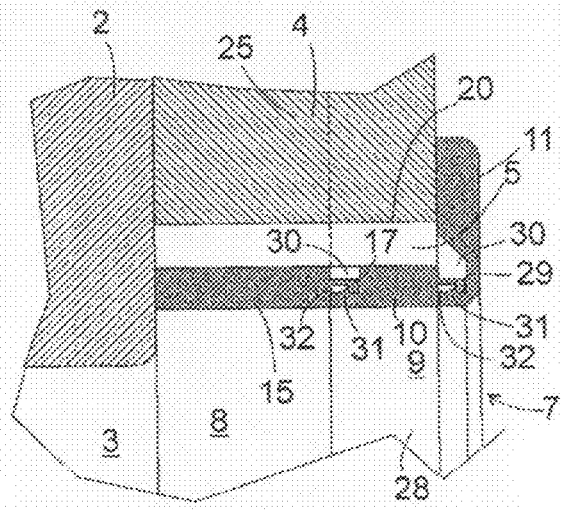
FIG. 6 shows a section through the frame piece and its surroundings according to a third embodiment.

In the embodiment shown in FIG. 6, the cover piece 7 is made in two parts, it being possible for one part to correspond to the web 11 covering the opening 5 of the decor plate 4 and the other the outer sleeve 28 of the embodiments described above. The form of the inner sleeve 8 is substantially the same as shown in FIG. 2. One end of the outer sleeve 28 is provided with a groove accommodating the spring 17 of the inner sleeve 8 and, congruent with the spring 17, the opposite end is provided with a spring 29 that engages with a groove of the web 11. In order to facilitate locking, one side wall of the grooves is provided with gaps 30 in places, and in each case the opposite side wall carries, at the same height of each gap 30, a latching projection 31 which engages with a lateral recess 32 of the spring 17 and 29, respectively.

In this embodiment, matching to varying thicknesses of the decor plate 4 is possible by fitting either just the outer sleeve 28, or only the inner sleeve 8 or both to the webs 11. While the two sleeves 8, 28 are made to have different lengths, adjustment to three different thicknesses of decor plate 4 is possible.

Figure 7:
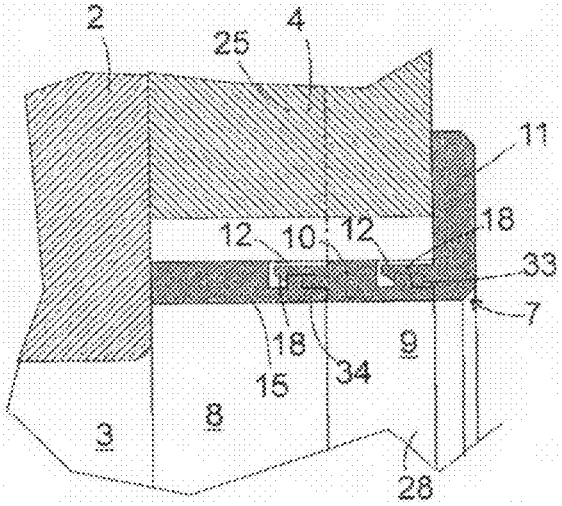
FIG. 7 shows a section through the frame piece and its surrounding according to a fourth embodiment.

FIG. 7 shows an embodiment in which, as is the case in FIG. 6, the cover piece 7 is divided on the one hand into the webs 11 and on the other hand only the outer sleeve 28. The outer sleeve 28 has a continuous groove with which a spring 33 of the webs 11 engages, and a spring 34 which engages with a continuous groove of the inner sleeve 8. As in the embodiment of FIGS. 2 to 4, in places the springs are flanked by flexible latching arms 18 which engage with a lateral recess 12 of the respective adjacent part, the difference being that in the embodiment of FIG. 7, recesses 12 are provided on the inner sleeve 8 and for these complementary latching arms 18 on the outer sleeve 28 are provided, or that the webs 11 carry latching arms 18 engaging in recesses 12 of the outer sleeve 28. Matching to various thicknesses of the decor plate 4 is achieved by omitting the outer sleeve 28 as required and mounting the inner sleeve 8 directly onto the webs 11. Alternately, a plurality of inner sleeves of varying length can also be provided, which, according to the thickness of the decor plate being used, are fitted to the webs 11.

The invention claimed is:

1. A built-in refrigerator having a housing formed with a front dispenser opening therein for accessing a dispenser, the refrigerator comprising:

a decor plate covering at least a portion of a front side of the housing, the decor plate having an opening therein corresponding to the front dispenser opening;

a frame member surrounding the opening in the decor plate and disposed in front of the front dispenser opening, wherein the frame member includes a cover piece overlapping edges of the opening in the decor plate and an inner sleeve arranged between the cover piece and the front side of the housing, the inner sleeve having an inner sleeve opening extending through the inner sleeve, the dispenser being accessible through the inner sleeve opening in the inner sleeve.

2. The built-in refrigerator according to claim 1 wherein the cover piece includes an outer sleeve engaged with the opening in the decor plate.

3. The built-in refrigerator according to claim 2 wherein the inner sleeve and the outer sleeve fit one inside the other in a telescopic manner.

4. The built-in refrigerator according to claim 2 wherein the inner sleeve and the outer sleeve have inner surfaces that are joined so as to be flush with each other.

5. The built-in refrigerator according to claim 2 wherein the inner sleeve and the cover piece are formed with a tongue-and-groove joint.

6. The built-in refrigerator according to claim 1 wherein the inner sleeve and the cover piece are formed with respective portions of an interacting latching arrangement.

7. The built-in refrigerator according to claim 6 wherein the latching arrangement includes a first latching contour formed at one edge of the cover piece, and a second latching contour for operative engagement with the first latching contour at an arm projecting from the inner sleeve.

8. The built-in refrigerator according to claim 7 wherein the first latching contour is arranged within a recess in an edge thereof wherein the recess fully accommodates the arm.

9. The built-in refrigerator of claim 1, wherein the inner sleeve is arranged entirely between the cover piece and the front dispenser opening in the front side of the housing.

10. The built-in refrigerator of claim 1, wherein the cover piece further comprises:

a plurality of outer sleeves arranged between the cover piece and the front side of the housing, one of the plurality of outer sleeves being coupled to the inner sleeve, each of the plurality of outer sleeves having an outer sleeve opening extending therethrough, the dispenser being accessible through the outer sleeve opening in each of the plurality of outer sleeves.

11. The built-in refrigerator of claim 10, wherein the inner sleeve and the one of the plurality of outer sleeves include respective portions of a first interacting latching arrangement, and wherein the cover piece and one of the plurality of outer sleeves include respective portions of a second interacting latching arrangement.

12. The built-in refrigerator of claim 1, wherein the inner sleeve is arranged between the cover piece and the front dispenser opening in the front side of the housing, wherein the cover piece further comprises:

an outer sleeve arranged between the cover piece and the inner sleeve, the outer sleeve being coupled to the inner sleeve, the outer sleeve having an outer sleeve opening extending therethrough, the dispenser being accessible through the outer sleeve opening in the outer sleeve.

13. The built-in refrigerator of claim 12, wherein the inner sleeve and the outer sleeve include respective portions of a first interacting latching arrangement, and wherein the cover piece and the outer sleeve include respective portions of a second interacting latching arrangement.

14. A built-in refrigerator comprising:

a housing having a front dispenser opening in a front side of the housing;

a dispenser mounted in the housing and accessible through the front dispenser opening;

a decor plate covering a portion of the front side of the housing, the decor plate having a decor plate opening corresponding to the front dispenser opening, the dispenser being accessible through the decor plate opening in the decor plate;

a frame member surrounding the decor plate opening and disposed in front of the front dispenser opening, wherein the frame member includes:

a cover piece overlapping edges of the decor plate opening and having a cover piece opening, the dispenser being accessible through the cover piece opening in the cover piece; and a first sleeve arranged between the cover piece and the front side of the housing, the first sleeve coupled to the cover piece and having a first sleeve opening extending through the first sleeve, the dispenser being accessible through the first sleeve opening in the first sleeve.

15. The built-in refrigerator of claim 14, wherein the cover piece further comprises:

a second sleeve arranged between the cover piece and the front side of the housing, the second sleeve coupled to the first sleeve and having a second sleeve opening extending through the second sleeve, the dispenser being accessible through the second sleeve opening in the second sleeve.

16. The built-in refrigerator of claim 14, wherein the cover piece further comprises:

a plurality of second sleeves arranged between the cover piece and the front side of the housing, one of the plurality of second sleeves being coupled to the first sleeve, each of the plurality of second sleeves having a second sleeve opening extending therethrough, the dispenser being accessible through the second sleeve opening in each of the plurality of second sleeves.

17. The built-in refrigerator of claim 15, wherein the second sleeve engages the decor plate opening in the decor plate.

* * * * *